United States Patent [19]

Farfaglia

[11] 4,131,057

[45] Dec. 26, 1978

[54] APPARATUS FOR FORMING A CONVOLUTED CONTAINER SIDEWALL

[75] Inventor: Silvio T. Farfaglia, Fulton, N.Y.

[73] Assignee: Phillips Petroleum Company, Bartlesville, Okla.

[21] Appl. No.: 727,910

[22] Filed: Sep. 29, 1976

[51] Int. Cl.[2] ..... B31B 1/32

[52] U.S. Cl. ..... 93/81 R

[58] Field of Search ..... 93/36.1, 396, 39.1, 93/39.2, 39.3, 54.1, 54.2, 54.3, 81 R, 81 MT

[56] References Cited

U.S. PATENT DOCUMENTS

| | | | |
|---|---|---|---|
| 1,892,675 | 1/1933 | Lyon et al. | 93/36.1 |
| 3,958,501 | 5/1976 | Richards | 93/81 MT X |

*Primary Examiner*—Roy Lake
*Assistant Examiner*—Paul A. Bell

[57] ABSTRACT

Apparatus for wrapping a sidewall blank about a mandrel utilizing two wrapping wings which are rotated about the mandrel axis by respective drive trains, each drive train comprising a shaft positioned coaxially with the mandrel, a lever arm connecting the wrapping wing to the shaft, a slide member positioned in a transversely extending slot in a common reciprocating carriage, and a crank arm secured to the shaft and pivotably connected to the slide member. One of the wiping wings can be provided with an L-shaped blade with one leg of the L-shaped blade extending forwardly in the direction of travel of that wiping wing during the wrapping operation to lead the blade of the other wiping wing.

14 Claims, 6 Drawing Figures

APPARATUS FOR FORMING A CONVOLUTED CONTAINER SIDEWALL

This invention relates to an apparatus for wrapping a sidewall blank about a mandrel to form a convoluted sidewall.

Numerous machines for wrapping a sidewall blank about a mandrel have been designed to employ a two-element or three-element clam shell mechanism for folding the blank about the mandrel. However the clam shell mechanism tends to slap the mandrel at the conclusion of the folding operation, causing noise and substantial machine stress. The clam shell mechanism also permits undesirable variations in the diameter of the formed tubular bodies. These difficulties can be avoided or at least minimized by employing two wrapping wings which are rotated about the mandrel axis to wrap the blank about the mandrel. However, when a blank is wrapped about a mandrel by using two wiper blades starting at locations intermediate the side edges of the blank, some means for wrapping one side edge ahead of the other side edge is necessary to achieve an overlap of the side edges without damaging the blank. This can be accomplished with each wiper blade being controlled by its own individual cam and lever system. However, rotary cams are expensive to design and to manufacture, and are not adapted to adjustments. Frank P. Richards, U.S. 3,958,501 discloses an apparatus for operating the two wiping wings wherein a lost motion mechanism permits the rotation of one of the wiping wings to be terminated before the opposite side margins are overlapped by the continued rotation of the other wiping wing. While this apparatus has the advantages of ease of design, construction and adjustment, the operation of the apparatus results in a high noise level. Substantial noise results from the resiliently mounted drive rod striking the metal stop pin, the flexing of the heavy duty spring on the resiliently mounted drive rod, and the backlash from the rack and pinion gear.

Accordingly, it is an object of the present invention to provide a new and improved apparatus for forming a convoluted tube. Another object of the invention is to provide a drive mechanism for two folding wings which does not employ rotary cams to differentiate between the rotation of the two folding wings. Another object of the invention is to provide a drive mechanism for two folding wings which has a low operating noise level. Other objects, aspects and advantages of the invention will be apparent from a study of the specification, the drawings and the appended claims to the invention.

Figure 1:
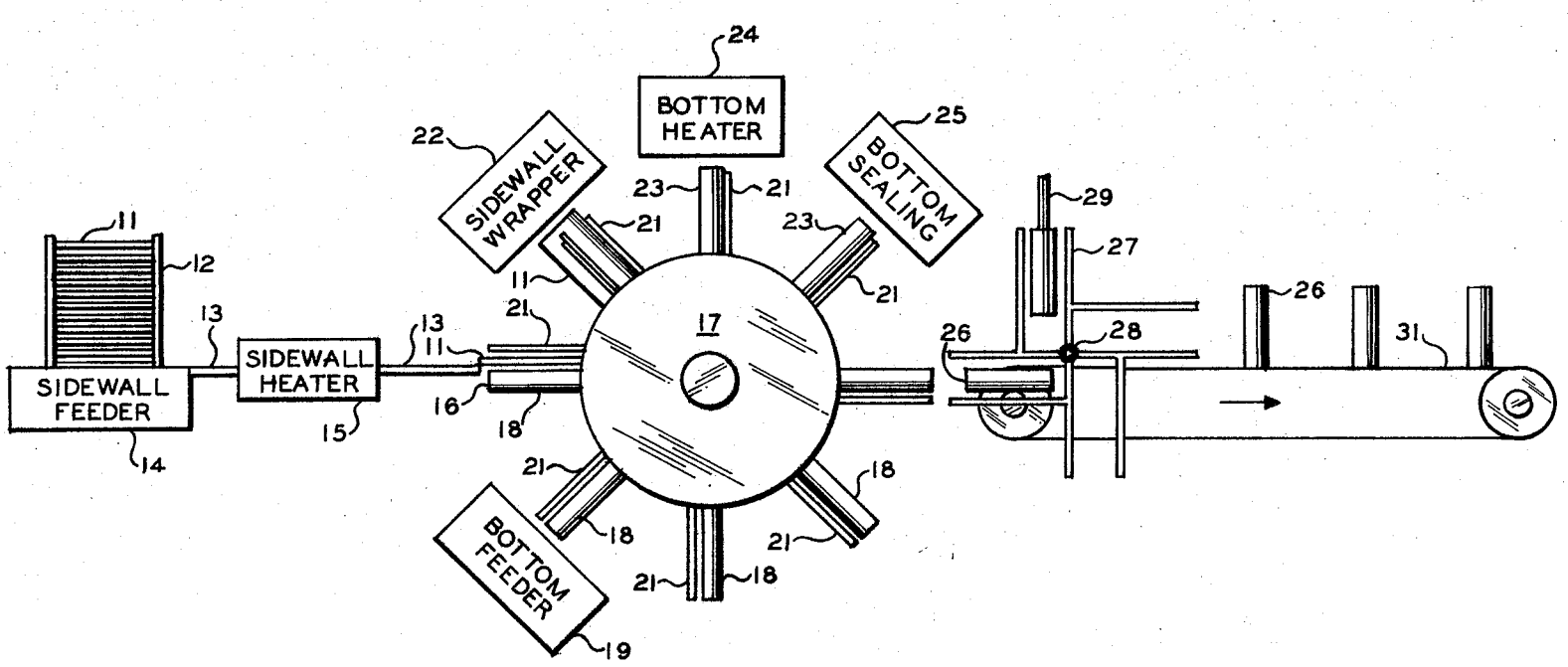
FIG. 1 is a diagrammatic representation of a container forming machine embodying the present invention.
Figure 2:
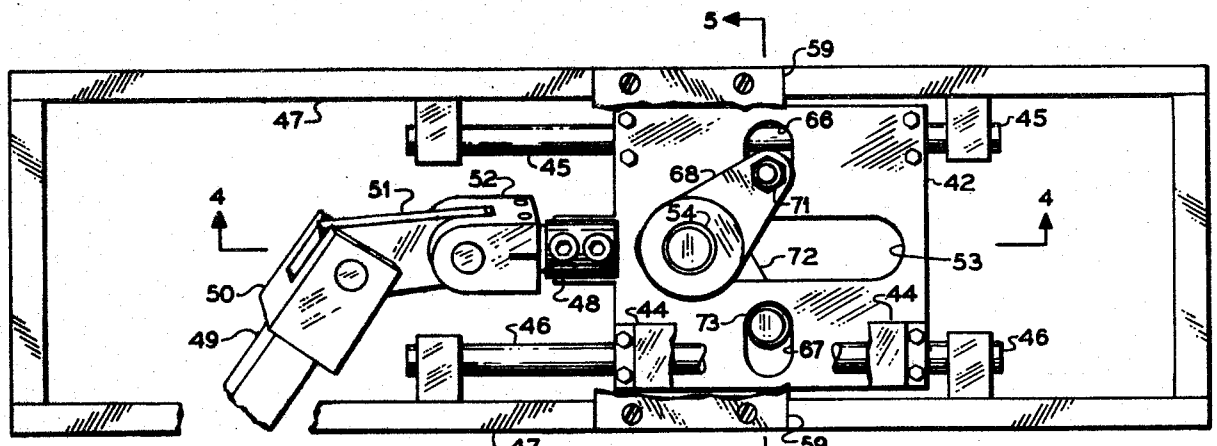
FIG. 2 is a plan view, partly in cross section, of the mechanism of the sidewall wrapping station of FIG. 1 in the open position.
Figure 3:
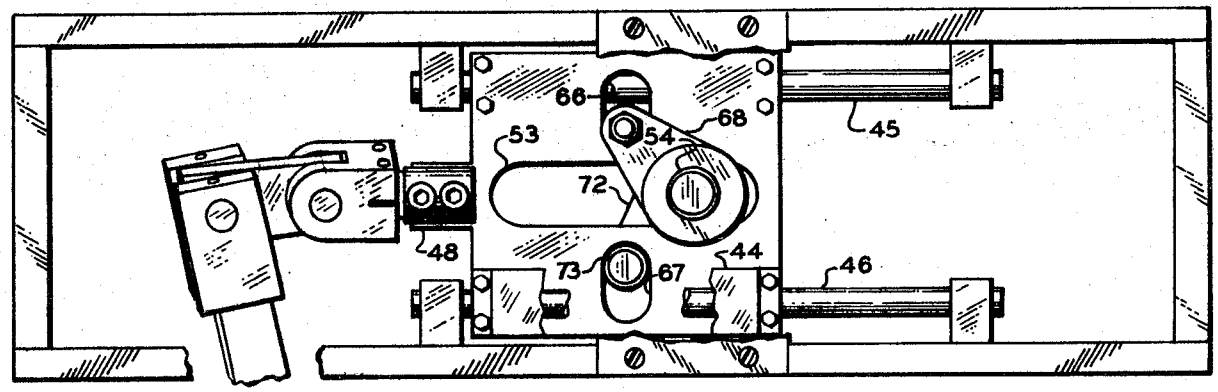
FIG. 3 is a plan view, partly in cross section, of the mechanism of the sidewall wrapping station in the closed position.

Referring now to FIG. 1 in detail, thermoplastic coated paperboard sidewall blanks 11 are individually withdrawn from magazine 12 and transferred to conveyor 13 by sidewall feeder 14. The blank 11 is passed through sidewall heater 15 to heat to a suitable bonding temperature the thermoplastic coating in the side marginal positions which are to be overlapped in the formation of the sidewall into a container and, if desired, in the bottom marginal position which is to be bonded to the bottom member 16. Turret 17 is mounted for rotation about its horizontal axis and is provided with a plurality of mandrels 18 which extend radially outwardly from said horizontal axis in a vertical plane perpendicular to said horizontal axis. The mandrels 18 are spaced apart on the turret 17 in a uniform manner. A suitable bottom feeder mechanism 19, for example a chip feeder, supplies individual bottom members 16 to the outermost end face of mandrels 18. Each mandrel 18 is provided with suitable means, for example a suction means, to hold the bottom member 16 in place on the end face of the mandrel. The turret rotates, stepwise, in a clockwise direction as viewed in FIG. 1, to move a bare mandrel to the bottom feeding station to receive a bottom member 16 and then to the horizontal position in alignment with conveyor means 13 to receive a heated blank 11. Each mandrel 18 has a sidewall clamp 21 associated therewith which is in the open position, spaced apart from its mandrel 18, at the sidewall blank receiving station to permit the heated blank 11 to be inserted between the mandrel 18 and clamp 21 by conveyor means 13. The clamp 21 is then actuated to secure the median or intermediate portion of the heated blank 11 in position on mandrel 18, after which the turret 17 is indexed to the next position to carry the secured blank 11 and bottom member 16 to the sidewall wrapping station. The sidewall wrapping means 22 wraps the blank 11 around mandrel 18 to form a convolute and to apply pressure to the overlapped heated side margins to bond the side margins, thereby forming a tubular sidewall 23.

At the next indexing of turret 17, the mandrel carrying the tubular sidewall 23 is moved from the sidewall wrapping station to the bottom heating station, where the margin of the sidewall adjacent the bottom member 16 is heated by bottom heating means 24 to a suitable bonding temperature. The turret 17 is then indexed to transport the mandrel 18 and the heated sidewall 23 to a bottom sealing station, where bottom sealing means 25 applies pressure to the heated portions of the sidewall 23 and bottom member 16 to form the bottom seal. In one embodiment the bottom member 16 has a shape at least substantially equal to the shape of the end face of mandrel 18, and the bottom margin of the tubular sidewall 23 is folded inwardly into contact with the bottom member 16 to form the bottom seam. A container of this type is illustrated by I. L. Wilcox in U.S. Pat. No. 3,369,726, issued Feb. 20, 1968. In another embodiment the bottom member 16 can be formed with a central disc portion having a diameter substantially equal to the diameter of the end face of mandrel 18 and an annular flange portion folded to extend outwardly from the mandrel 18 at least approximately parallel to the side surface of the mandrel 18. In the latter embodiment the flange portion of the bottom member 16 can be bonded to the contacting surface of the tubular sidewall 23. If desired, the tubular sidewall bottom margin can be longer than the flange of bottom disc member 16 to permit the bottom margin to be folded approximately 180° to form a U which contacts both sides of the flange of bottom member 16. If desired, the bottom seam can be rolled by suitable known means. Where the bottom member 16 is flanged, bottom feeder 19 can employ a suction cup transfer mechanism, or flat discs can be chip fed and then forced through a die to form the flange and then applied to the end face of mandrel 18.

After the bottom seal is formed, the turret 17 is indexed to transport the formed container 26 to a stripping station, and the associated clamp 21 is moved to the open position to release the container 26. Although any suitable mechanical stripping means can be employed, it is presently preferable to utilize pneumatic pressure applied through the mandrel to the inside of the container to eject the container from the mandrel 18 into a pocket of turret 27. Turret 27 is rotated stepwise about horizontal axis 28 to move the ejected container 26 from the initial horizontal position to a vertical position with the open end up. A pusher arm 29 is moved through the upright pocket of turret 27 to move the container 26 onto conveyor 31. If desired, two conveyors can be positioned on opposite sides of turret 27 and pusher arm 29 can move alternate containers to opposite conveyors.

Figure 4:
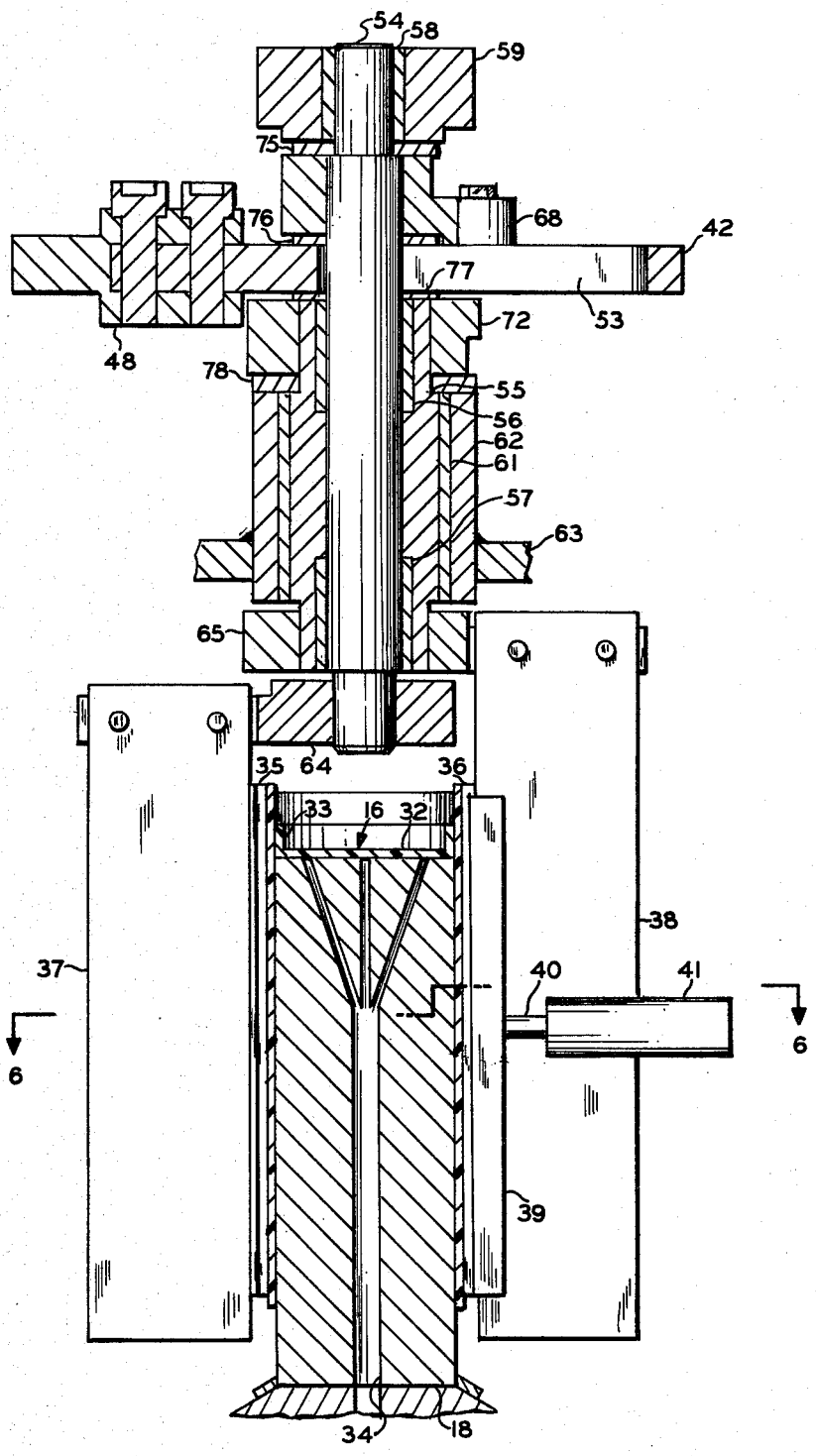
FIG. 4 is a partial elevational view in cross section taken along the line 4—4 in FIG. 2.
Figure 5:
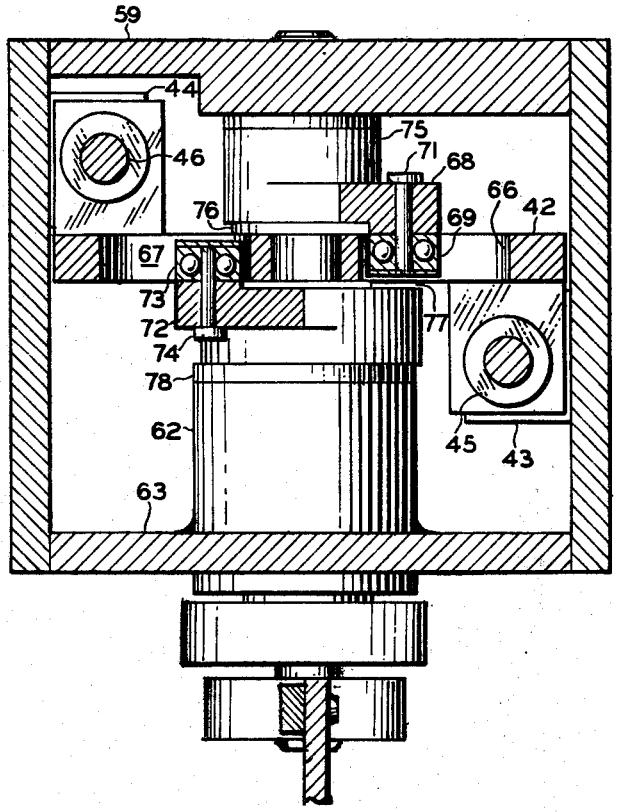
FIG. 5 is a cross-sectional view taken along line 5—5 in FIG. 2.

Referring now to FIG. 4, bottom member 16 is illustrated as having a central disc portion 32 and an annular flange portion 33 and is held in place on the end face of mandrel 18 by the subatmospheric pressure maintained in conduit 34 and its branches. Spring biased wiping blades 35 and 36, carried by folding wing 37 and 38, respectively, contact the outer surface of sidewall blank 11 on opposite sides of the respective clamp 21 when mandrel 18 is indexed into the sidewall wrapping station. The folding wings 37 and 38 are then actuated to rotate about the longitudinal axis of the mandrel 18 in opposite directions at an at least substantially constant distance from the longitudinal axis of the mandrel 18 to wrap the sidewall blank 11 around mandrel 18 with one side margin of blank 11 overlapping the opposite side margin of blank 11 to form the convolute container sidewall 23. The leading edge of blade 35 can be rotated in advance of the leading edge of blade 36 by a few degrees so that blade 35 causes the left edge portion of sidewall blank 11 to fold against mandrel 18 before blade 36 folds the right edge portion of blank 11, thereby causing the right edge portion of blank 11 to overlap the left edge portion thereof. When the rotation of blades 35 and 36 is completed, sealing head 39 is actuated by piston 40 of pneumatic cylinder 41 to press the heated right edge portion of blank 11 against the heated left edge portion thereof to achieve a thermal bonding of the thermoplastic coatings and thereby form the convoluted container sidewall 23. For sake of simplicity the cylinder 41 is shown perpendicular to sealing head 39 and directly connected thereto. However, in a presently preferred embodiment the cylinder 41 is mounted on the frame in a stationary position approximately parallel to sealing head 39 when head 39 is in the sealing position. A pivoted rocker arm mechanism, which is mounted on folding wings 38 and operates sealing head 39 via a spring biased plunger, rotates into position to be operated by the piston 40 of cylinder 41, thereby translating the motion of the piston 40 of cylinder 41 approximately 90° to move the sealing head 39 against the overlapped side margins of blank 11.

Referring now to FIGS. 2–6, the actuation mechanism of sidewall wrapping means 22 comprises a carriage 42 which is mounted for forward and retractive motion by sleeve bearings 43 and 44 on guide rods 45 and 46 secured to housing 47. The motion of carriage 42 is effected by coupling 48, which is actuated by oscillating shaft 49, yoke 50, connecting linkage 51 and yoke 52. Shaft 49 can be oscillated by a rotary cam in the indexing mechanism (not shown) for turret 17. Carriage 42 has a first opening 53 therethrough extending in the direction of the reciprocating motion of carriage 42. A shaft 54 is positioned in opening 53 so as to be coaxial with and axially spaced from the mandrel 18 which is in the sidewall blank wrapping station of turret 17. Opening 53 is sufficiently large in both the longitudinal and transverse directions to prevent interference between carriage 42 and shaft 54. A sleeve shaft 55 is mounted coaxially with and surrounding an intermediate portion of shaft 54 by means of bushings 56 and 57. The upper end of shaft 54 is mounted in bushing 58 in a cross bar 59 which extends between opposite sides of housing 47. A bushing 61 is positioned between sleeve 55 and cylindrical support wall 62 which is welded to cross bar 63 which extends between opposite sides of housing 47. Wrapping wing 37 is connected to the lower end of shaft 54 by arm clamp 64, while wrapping wing 38 is connected to the lower end of sleeve shaft 55 by arm clamp 65. Arm clamps 64 and 65 are provided with suitable means, not shown, for fixed engagement with shaft 54 and sleeve 55, respectively, such that the rotation of shaft 54 and sleeve 55 effects the corresponding rotation of arm clamps 64 and 65. Suitable engaging means includes keys in keyways and set screws.

Carriage 42 is provided with linear slots 66 and 67, which extend along a straight line perpendicular to the direction of reciprocating motion of carriage 42. One end of lever arm 68 is secured about shaft 54 for rotation therewith, while a slide means, e.g., roller 69, is positioned in slot 66 and is pivotably attached to the other end of lever arm 68 by shaft 71. One end of lever arm 72 is secured about sleeve 55 for rotation therewith while a slide means, e.g., roller 73, is positioned in slot 67 and is pivotably attached to the other end of lever 72 by shaft 74. A thrust bearing 75 is positioned about shaft 54 between lever 68 and bar 59, while a thrust bearing 76 is positioned about shaft 54 between lever 68 and carriage 42. A thrust washer 77 is positioned about shaft 54 between carriage 42 and sleeve 55, while a thrust washer 78 is positioned about sleeve 55 between lever 72 and support wall 62.

Figure 6:
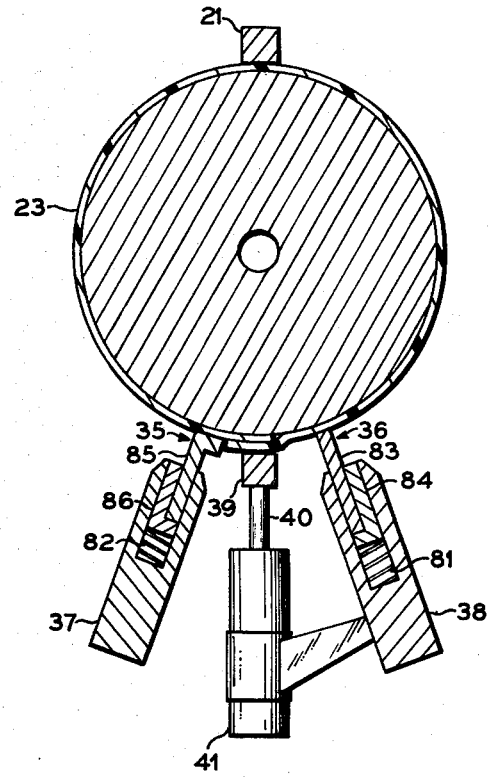
FIG. 6 is a cross-sectional view taken along line 6—6 in FIG. 4.

Referring now to FIG. 6, wiping blade 36 is resiliently biased in the frame of right folding wing 38 by spring means 81, while wiping blade 35 is resiliently biased in the frame of left folding wing 37 by spring means 82. Wiping blades 35 and 36 can be formed of any suitable material which will not damage the surface of the blank 11, e.g. nylon. In a presently preferred embodiment, blade element 83 is a ⅛-inch thick flat bar nylon element having the blank contacting surface curved in the form of a semicircle having a 1/16-inch radius and mounted on a steel backup bar 84, while blade 35 has a nylon element 85 having a generally L-shaped configuration mounted on a steel backup bar 86, each leg having a thickness of approximately ⅛-inch. The long leg of blade element 85 is at least substantially radial to the axis of mandrel 18, while the short leg extends approximately ⅛-inch beyond the long leg in the direction of movement of blade element 85 during the wrapping operation. Thus the leg of blade element 85 contacting the blank 11 has a total length of approximately ¼-inch in this particular embodiment. Also in this particular embodiment the blade element 83 is mounted with the trailing edge thereof, along the mid-line of folding wing 38 while the blade element 85 is mounted in folding wing 37 with the trailing edge thereof offset toward the leading side of folding wing 37, and the folding wings 37 and 38 are mounted such that the angle between the clamp 21 and the trailing edge of blade element 85 is at least equal to, if not slightly greater than, the angle between the clamp 21 and the mid-line of blade element 83, such that the leading edge of L-shaped blade element 85 is several degrees in advance of the leading edge of blade element 83, to thereby cause the side margin of blank 11 contacted by blade element 85 to fold inwardly under the opposite side margin of blank 11 contacted by blade element 83. The leading edge of blade element 85 extends forwardly of the adjacent leading edge of folding wing 37 to provide for clearance between folding wing 37 and sealing head 39 at the conclusion of the wrapping motion.

After the completion of the sealing operation, the indexing mechanism for turret 17 causes turret 17 to move the mandrel 18 carrying the newly formed tubing 23 out of the sidewall wrapping station toward the bottom heating station and the mandrel 18 carrying the newly fed blank 11 to move out of the sidewall blank receiving station toward the sidewall blank wrapping station. Upon the commencement of the movement of the mandrel 18 carrying the tubing 23, oscillating shaft 49 is activated to cause wrapping wings 37 and 38 to retract from the wrapped or closed position, shown in FIG. 6, to the open position, thereby permitting the mandrel 18 carrying the newly fed blank 11 to enter the sidewall blank wrapping station.

Reasonable variations and modifications are possible within the scope of the foregoing disclosure, the drawings and the appended claims to the invention. While slots 66 and 67 have been shown in the plate element of carriage 42, the carriage 42 can be provided with any suitable means defining the first and second slots 66 and 67, preferably a rigidly fixed part of the carriage 42. While slots 66 and 67 have been illustrated in the presently preferred position of extending along a single straight line perpendicular to the direction of reciprocating motion of carriage 42, the slots 66 and 67 can be positioned along separate lines which intersect the direction of reciprocating motion at angles other than 90°. However, it is still desirable that the slots be positioned such that the slide elements have a component of travel perpendicular to the direction of reciprocating motion. If desired, for ease in manufacture, slots 66 and 67 can intersect opening 53 or be in the form of a single slot when opening 53 is not employed or does not intersect the slots. The alignment of slots 66 and 67 along a single straight line perpendicular to the direction of reciprocating motion is particularly advantageous in the machining of the slots in plate 42. While the slide elements 69 and 73 have been illustrated as rollers, any other suitable slide element could be employed. The width of the slide elements is preferably just sufficiently less than the width of the corresponding slot to permit freedom of movement of the slide element along the length of the slot, while avoiding any significant play of the slide element in a direction transverse to the slot. In a presently preferred embodiment the clearance between the slide elements and the adjacent walls of the slot is approximately 0.002 inch. The movement of the wrapping wings under the sole control of the slide members provides for the relatively smooth operation of the wrapping wings in contacting the blank 11 and wrapping the blank about the mandrel as compared to the slapping of the clam shell mechanisms. While the shaft 54 has been illustrated as extending through opening 53 in carriage 42 for compactness and minimum length of lever arms 68 and 72, it is possible for shaft 54 to be positioned outside of carriage 42 by employing longer lever arms 68 and 72. While sleeve bearing 43 has been illustrated on the underside of plate 42 to provide clearance for lever arm 68, both sleeve bearings 43 and 44 can be mounted on the same side of plate 42 where clearance is not a problem.

That which is claimed is:

1. Apparatus for wrapping a blank about a mandrel, with the mandrel being in a blank wrapping position, to form a convoluted tubular sidewall, which comprises a mandrel; a clamping means associated with said mandrel to hold an intermediate portion of a blank therebetween; first and second folding wing means; each of said first and second folding wing means having a frame, a wiping blade and means for resiliently mounting the wiping blade in the frame for movement of the blade along a line radial to the longitudinal axis of said mandrel when said mandrel is in the blank wrapping position; said first and second folding wing means being positioned for the wiping blades to contact the outer surface of the thus held blank on opposite sides of said clamping means; means for rotating each of said first and second folding wing means about the longitudinal axis of said mandrel in the blank wrapping position in an at least substantially constant distance from the longitudinal axis of said mandrel to wrap the blank about said mandrel with one side margin of said blank overlapping the opposite side margin of said blank; and means for sealing the thus overlapped side margins to thereby form a convoluted tubular sidewall; one of said wiping blades having a generally L-shaped configuration with one leg of the L-shaped wiping blade forming the surface which contacts said blank, said one leg extending forwardly in the direction of movement of said L-shaped wiping blade during the wrapping of said blank about said mandrel to lead the forward edge of the other of said wiper blades to cause the side margin of said blank contacted by said L-shaped wiping blade to fold inwardly under the opposite side margin of said blank contacted by the other of said wiper blades.

2. Apparatus in accordance with claim 1 wherein said one leg of said L-shaped wiping blade extends forwardly past the frame of the folding wing means in which said L-shaped wiping blade is mounted.

3. Apparatus in accordance with claim 2 wherein said L-shaped wiping blade is a unitary blade element having an L-shaped configuration and is mounted on a backup element.

4. Apparatus in accordance with claim 1 wherein said means for rotating comprises a carriage, guide means for supporting said carriage, means for effecting forward and retractive motion of said carriage in said guide means in a reciprocating manner, first and second shafts, said second shaft being a sleeve positioned about and coaxially with said first shaft, said carriage having a first opening therein with said first shaft extending through said first opening, said first opening being sufficiently large in the direction of the reciprocating motion of said carriage to prevent interference between said carriage and said first and second shafts, said carriage having means defining first and second slots therein extending at least generally transversely to said direction of the reciprocating motion, a first slide element in said first slot in operative engagement therewith, means connecting said first slide element to said first shaft for rotating said first shaft responsive to movement of said first slide element, and a second slide element operatively positioned in said second slot in operative engagement therewith, and means connecting said second slide element to said second shaft for rotating said second shaft responsive to movement of said second slide element.

5. Apparatus for wrapping a blank about a mandrel, with the mandrel being in a blank wrapping position, to form a convoluted tubular sidewall, which comprises a mandrel; a clamping means associated with said mandrel to hold an intermediate portion of a blank therebetween; first and second folding wing means; each of said first and second folding wing means having a frame, a wiping blade, and means for resiliently mounting the wiping blade in the frame for movement of the blade along a line radial to the longitudinal axis of said mandrel when said mandrel is in the blank wrapping position; said first and second folding wing means being positioned for the wiping blades to contact the outer surface of the thus held blank on opposite sides of said clamping means; means for rotating each of said first and second folding wing means about the longitudinal axis of said mandrel in the blank wrapping position at an at least substantially constant distance from the longitudinal axis of said mandrel to wrap the blank about said mandrel with one side margin of said blank overlapping the opposite side margin of said blank; and means for sealing the thus overlapped side margins to thereby form a convoluted tubular sidewall; said means for rotating comprising a carriage, guide means for supporting said carriage, means for effecting forward and retractive motion of said carriage in said guide means in a reciprocating manner, first and second shafts, said second shaft being a sleeve positioned coaxially with and about an intermediate portion of said first shaft, said carriage having means defining first and second slots therein extending at least generally transversely to the direction of the reciprocating motion of said carriage, a first slide element positioned in said first slot in operative engagement therewith, means connecting said first slide element to said first shaft for smoothly rotating said first shaft responsive to movement of said first slide element transversely to said direction of the reciprocating motion, a second slide element positioned in said second slot in operative engagement therewith, and means connecting said second slide element to said second shaft for smoothly rotating said second shaft responsive to movement of said second slide element transversely to said direction of the reciprocating motion.

6. Apparatus in accordance with claim 5 wherein said carriage has a first opening therein with said first shaft extending through said first opening, said first opening being sufficiently large in the direction of the reciprocating motion of said carriage to prevent interference between said carriage and said first shaft.

7. Apparatus in accordance with claim 5 wherein said first and second slots are linear slots extending along a straight line at least substantially perpendicular to said direction of the reciprocating motion of said carriage.

8. Apparatus in accordance with claim 5 wherein said means for rotating provides for contact of one of said wiping blades with said blank in lead of the other of said wiping blades so that the side margin of the blank contacted by the leading wiping blade is folded under the side margin contacted by the other wiping blade.

9. Apparatus in accordance with claim 5 wherein said carriage and said means defining first and second slots comprises a plate having said first and second slots formed therein.

10. Apparatus in accordance with claim 9 wherein said plate has a first opening therein with said first shaft extending through said first opening, said first opening being sufficiently large in the direction of the reciprocating motion of said carriage to prevent interference between said carriage and said first shaft.

11. Apparatus in accordance with claim 10 wherein said first and second slots are linear slots extending along a straight line at least substantially perpendicular to said direction of the reciprocating motion of said carriage.

12. Apparatus in accordance with claim 11 wherein said means for rotating provides for contact of one of said wiping blades with said blank in lead of the other of said wiping blades so that the side margin of the blank contacted by the leading wiping blade is folded under the side margin contacted by the other wiping blade.

13. Apparatus in accordance with claim 12 wherein said leading wiping blade has a generally L-shaped configuration with one leg of the L-shaped wiping blade forming the surface which contacts said blank, said one leg extending forwardly in the direction of movement of said L-shaped wiping blade during the wrapping of said blank about said mandrel to lead the forward edge of the other of said wiper blades to cause the side margin of said blank contacted by said L-shaped wiping blade to fold inwardly under the opposite side margin of said blank contacted by the other of said wiper blades.

14. Apparatus in accordance with claim 13 wherein said one leg of said L-shaped wiping blade extends forwardly past the frame of the folding wing means in which said L-shaped wiping blade is mounted.

* * * * *